United States Patent [19]

Glanvall et al.

[11] 4,021,166

[45] May 3, 1977

[54] ROTARY VANE COMPRESSOR WITH INCREASED OUTLET THROUGH-FLOW AREA

[75] Inventors: Rune Glanvall, Norrkoping; Hans Kalen, Kolmarden; Kurt Pettersson, Norrkoping, all of Sweden

[73] Assignee: Stal-Refrigeration AB, Norrkoping, Sweden

[22] Filed: Dec. 1, 1975

[21] Appl. No.: 636,377

[52] U.S. Cl. ..... 418/183; 418/236

[51] Int. Cl.[2] ..... F04C 17/00; F04C 29/08

[58] Field of Search ..... 418/183, 189, 236, 238, 418/259–270

[56] References Cited

UNITED STATES PATENTS

| | | | |
|---|---|---|---|
| 2,254,938 | 9/1941 | Dick et al. | 418/189 |
| 2,708,884 | 5/1955 | Deschamps | 418/238 |
| 3,900,277 | 8/1975 | Newton | 418/236 |

*Primary Examiner*—John J. Vrablik

*Attorney, Agent, or Firm*—Cyrus S. Hapgood

[57] ABSTRACT

To allow a large built-in volume ratio of a vane type compressor, the outer circumferential surface of the rotor is provided in each working chamber with an indentation located next to the leading one of the two vanes partly defining the chamber, thereby increasing the through-flow area of the outlet space of the chamber through which it communicates with the stator's outlet port during the exhaust of compressed gas from the chamber.

3 Claims, 4 Drawing Figures

ROTARY VANE COMPRESSOR WITH INCREASED OUTLET THROUGH-FLOW AREA

The present invention relates to a vane type rotary compressor comprising a stator with end plates, and a rotor that is rotatably journalled in the stator and is provided with vanes arranged to slide in slots in the rotor and seal against the end plates and against a generally cylindrical inner surface of the stator. Working chambers are formed between the vanes, the rotor and the cylindrical inner surface, and compressed gaseous medium is exhausted from the individual working chambers to an outlet channel via an outlet port arranged in the cylindrical inner surface.

Depending on the degree of increase of the pressure of the gaseous medium that such a compressor is to bring about, the compressor is constructed with a so-called built-in volume ratio that corresponds to the desired increase of the pressure. By the built-in volume ratio is meant the ratio between the largest volume of a working chamber (on completion of its intake) and the smallest volume of a working chamber (just prior to its exhaust). To get a large built-in volume ratio in the compressor, the outlet port in the stator can be displaced closer to the sealing place between the rotor and the stator. However, this means a reduction of the height of the outlet space created between the outlet channel and the working chamber during the exhaust. With a built-in volume ratio of a certain magnitude, therefore, the speed of the gaseous medium, and thereby the pressure drop, in the outlet space becomes so large that the advantage with the increased built-in volume ratio is lost.

The present invention aims at avoiding this disadvantage and thus increasing the through-flow area of the outlet space (which during the exhaust constitutes a communication between the individual working chamber and the the outlet channel), thereby making it possible to allow a large built-in volume ratio of the compressor.

According to the invention, this aim is achieved by providing the outer circumferential surface of the rotor in each individual working chamber with an indentation that is placed next to the forward vane of the individual working chamber, reckoned in the direction of rotation of the rotor.

An embodiment of the invention is described below with reference to the appended drawing, in which FIG. 1 is a sectional view on line I—I in FIG. 2 of a vane type rotary compressor of the double chamber type;

FIG. 1*a* is a detail view of an outlet space for the gaseous medium;

Figure 1:
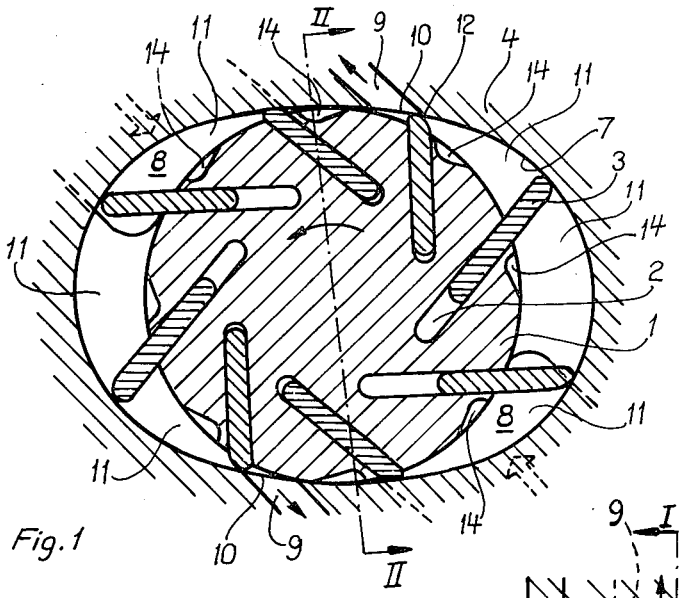

Referring to the drawing, a rotor 1 is provided with slots 2 in which vanes 3 are slidably supported. The rotor 1 is enclosed in a stator comprising a jacket 4 and a pair of end plates 5, the rotor being rotatably journalled in the end plates 5 and rotated by means of a shaft 6. The vanes 3 seal partly against an inner surface 7 of the jacket 4, the inner surface 7 being generally cylindrical and having an elliptical cross section, and partly against the end plates 5.

Between the vanes 3, the rotor 1 and the inner surface 7, working chambers 11 are formed which are supplied with the gaseous medium to be compressed through inlet ports 8 arranged in the end plates 5. The compressed gaseous medium is led out from the working chambers 11 to outlet channels 9 via outlet ports 10 that are arranged in the inner surface 7.

The built-in volume ratio of the compressor is the ratio between the largest volume of a working chamber 11, which occurs immediately before the exhaust. To increase this built-in volume ratio, the forward edge 12 of the outlet port 10 can be displaced in the direction of rotation of the rotor (see FIG. 1*a*), but this means a reduction of the outlet space 13 and therefore an increased speed of the flow and an increased pressure drop in the outlet space 13, the pressure drop being proportional to the square of the speed of the flow. The speed of the flow and the pressure drop also depend on the change in the volume of the working chamber 11 during the exhaust as well as on the area of the outlet space. The change in the volume and also the area of the outlet space are in turn a function of the geometry of the compressor and its built-in volume ratio. Increasing speed, increasing built-in volume ratio and increasing the number of working chambers are factors tending to increase the speed of the exhaust flow and the pressure drop, which can reach values that have a great influence on the power consumption of the compressor and can damage parts of it.

To lower critically large pressure drops to an acceptable level, each working chamber 11 is provided with an indentation 14 in the outer circumferential surface of the rotor 1, the indentation 14 being placed and dimensioned so that the speed of the flow through the outlet space 13*a* (FIG. 3) never exceeds what can be characterized as a critical limit.

Even though the indentation 14 forms a so-called dead space, a smaller pressure drop and consequently a better effect of the compressor are obtained according to the invention by the lower speed of the flow in the outlet space 13*a*. The volume of the indentation 14, however, should be limited as much as possible, and therefore it is suitable to form the indentation 14 so that the speed of the flow in the outlet space is kept at a constant, allowable level.

Figure 1A:
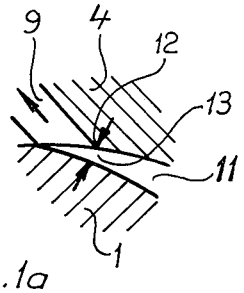
Figure 2:
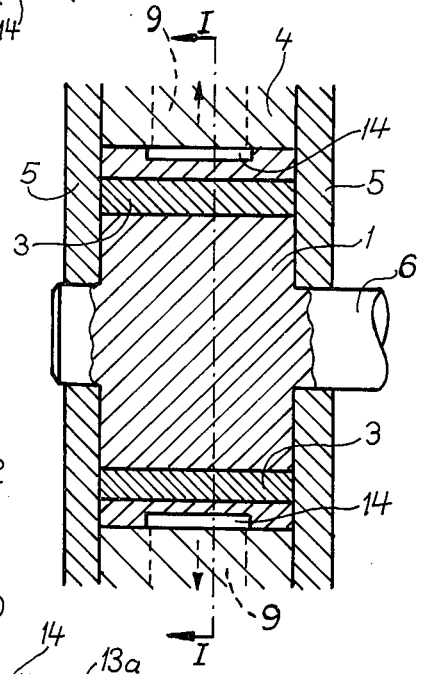
FIG. 2 is a sectional view of the compressor on the line II—II in FIG. 1.
Figure 3:
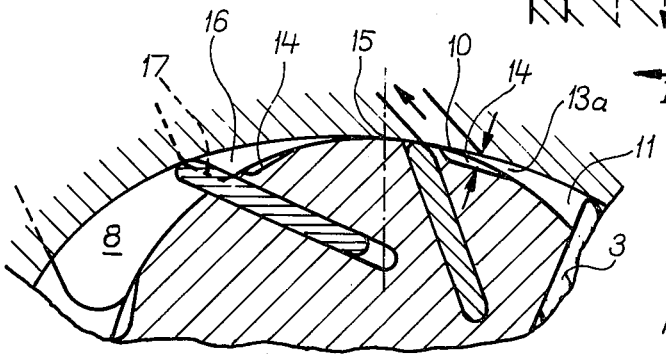
FIG. 3 is a detail view of the area around a sealing place in the compressor.

Each indentation 14 should be arranged where the speed of the flow tends to become largest, i.e., immediately behind the leading vane 3 partly defining the space, so that the largest through-flow area of the outlet space is obtained at the rotor position shown in FIG. 3. With continued rotation, the indentation 14 slides past the outlet port 10 so that the outlet space between the stator and the rotor decreases, but simultaneously the distance between the stator and the rotor at the rear vane decreases, which means a decreased speed of the flow, whereby the outlet space 13 in FIG. 1*a* give sufficient through-flow area. The dimensions of the indentation 14 are simply determined by the speed of the exhaust flow that can be allowed. In FIG. 2, the indentation 14 is shown to take about 50% of the width of the rotor.

The gaseous medium in the indentation 14, after it has passed the sealing region 15, will expand to the actual inlet pressure; and in the embodiment according to FIG. 1, this expansion work is not utilized. By letting the gaseous medium expand in an enclosed space 16 (FIG. 3) defined by the rotor, the stator, a vane and the end plates, the expansion work can be utilized. This is obtained by displacing the forward edge 17 of the inlet port 8 in the rotation direction of the rotor.

For optimum use, the space 16 should be so large that the pressure in it is lowered to the actual inlet pressure. Thereafter, the space 16 is placed in communication with the inlet channel at port 8.

Each indentation 14 in the rotor 1 has a certain circumferential extension which, if the sealing at the sealing region 15 is a line sealing, causes a certain direct blow-over from the high pressure to the low pressure side, which corresponds to a larger dead space than is formed by the indentation 14. To decrease the losses, the sealing region 15 should be a band-like sealing region having at least the same circumferential extension as the indentation 14.

We claim:

1. A vane type rotary compressor comprising a hollow stator having end plates and forming a generally cylindrical inner surface, a rotor mounted for rotation in the stator and having an outer circumferential surface provided with slots, and vanes arranged to slide in said slots and to seal against the end plates and against said cylindrical inner surface of the stator, working chambers being formed between the vanes, the rotor and said cylindrical inner surface, the stator having an inlet port for admission of gas to be compressed and also having an outlet channel, said cylindrical inner surface having an outlet port through which compressed gas is exhausted to said channel from the individual working chambers as the rotor rotates, each said chamber forming an outlet space through which the chamber communicates with said outlet port during said exhaust of compressed gas from the chamber, the compressor being characterized in that, in order to increase the through-flow area of said outlet space and thereby allow a large built-in volume ratio of the compressor, the outer circumferential surface of the rotor is provided in each working chamber with an indentation confined mainly to a region located next to the vane partly defining the chamber and which is the leading vane of the chamber reckoned in the rotation direction of the rotor, said indentation being substantially spaced from the trailing vane of the chamber.

2. The compressor of claim 1, in which said outer surface of the rotor contacts said cylindrical inner surface of the stator to form a sealing region, each vane, after passing said region and before reaching said inlet port, defining with the rotor and stator an expansion space for expansion of gas remaining in the corresponding indentation, said inlet port being spaced from said region sufficiently to prevent said expansion space from opening into the inlet port until the pressure in the expansion space has decreased to substantially the pressure in said inlet port.

3. The compressor of claim 2, in which said sealing region extends circumferentially of the rotor to substantially the same extent as each said indentation.

* * * * *